United States Patent [19]

Fiedler

[11] Patent Number: 5,065,910

[45] Date of Patent: Nov. 19, 1991

[54] DISPENSER HEAD FOR FLOWABLE MATERIALS

[76] Inventor: Edgar F. Fiedler, 147 Avenue, Nobleton, Ontario, Canada

[21] Appl. No.: 476,319

[22] Filed: Feb. 7, 1990

[30] Foreign Application Priority Data

Jun. 30, 1989 [CA] Canada ..... 604552

[51] Int. Cl.[5] ..... B67D 5/00

[52] U.S. Cl. ..... 222/504; 222/559; 222/571; 141/117

[58] Field of Search ..... 222/262, 571, 559, 504, 222/108; 141/115, 116, 117

[56] References Cited

U.S. PATENT DOCUMENTS

| | | | |
|---|---|---|---|
| 2,640,630 | 6/1953 | Genco | 222/559 |
| 2,721,008 | 10/1955 | Morgan, Jr. | 222/571 |
| 2,839,226 | 6/1958 | Ross | 141/117 |
| 3,160,331 | 12/1964 | Trumbull et al. | 222/504 |
| 3,351,250 | 11/1967 | West | 222/571 |
| 3,459,340 | 8/1969 | Smith | 222/571 |
| 3,557,820 | 1/1971 | Jackson et al. | 222/149 |
| 4,516,702 | 5/1985 | Schmidt | 222/571 |
| 4,809,885 | 3/1989 | Hayashi et al. | 222/571 |
| 4,877,160 | 10/1989 | Derving | 137/512.3 |
| 4,955,514 | 9/1990 | Dickau | 222/518 |

*Primary Examiner*—Kevin P. Shaver
*Assistant Examiner*—Anthoula Pomrening

[57] ABSTRACT

A dispenser for flowable materials has a dispensing head with a chamber having inlet and discharge openings of a predetermined volume, a closure to open and close the inlet, a body which can be positioned in the chamber, for occupying a portion of its volume, a supply of flowable material to the inlet, and, the body being moveable so that at least a portion of the body is withdrawn from the chamber to increase the effective volume of the chamber and cause material in the discharge opening to be sucked back into the chamber.

7 Claims, 2 Drawing Sheets

DISPENSER HEAD FOR FLOWABLE MATERIALS

FIELD OF THE INVENTION

The invention relates to a dispenser head for flowable materials particularly viscous materials, and liquids and in particular to such a dispenser head incorporating a shut-off valve providing a suck-back action.

BACKGROUND OF THE INVENTION

In many applications for dispensing of flowable materials, and liquids, it is required to be able to start and stop the dispensing action many times. Many dispensers or applicators of flowable materials provide some form of shut-off valve, but these are often of only limited application. In many cases, the valves in such dispensers are not efficient even working under optimum conditions. Even after the valves are shut off, residues of material will cling to the nozzle, or drip on to the workpiece or machinery. With thicker, more viscous materials or liquids, the problem becomes more aggravated. With many designs of shut-off valves, even after the valve has been closed, the material or liquid strings out from the nozzle, or clings to the nozzle, resulting in the placement of an inaccurate deposit of the material on the workpiece, or leaving material from the dispensing head, stringing to the machinery or to the workpiece, in places where it is not required.

While a wide variety of viscous materials and liquids may require dispensing in this way, the dispensing of adhesives and bonding agents presents these problems in a particularly acute form. In order to overcome these problems, operators must continually wipe the tip of the dispenser in a manual operation. Automatic equipment exists for wiping the nozzle each time the valve shuts off flow. This wiping device, which is sometimes in the form of a roll of paper, will eventually be discarded after use. This can present a problem of hazardous waste, if the adhesive material is harmful, and may present significant design problems in the design and operation of the dispensing machinery.

BRIEF SUMMARY OF THE INVENTION

With a view to solving these various problems, the invention comprises a dispenser apparatus having a dispensing head defining a chamber having an inlet opening and a discharge opening, and defining a predetermined volume, closure means movably operable to open and close said inlet opening, and having operating means therefor, body means adapted to be positioned in said chamber, for occupying a portion of said predetermined volume, thereby reducing the effective volume thereof, and being at least partially removable therefrom whereby to increase said effective volume thereof, means for supplying said flowable material to said inlet opening, said material flowing from said inlet opening through said chamber, and out of said discharge opening, and means for moving said body means to a point wherein at least a portion of said body means is located exteriorly of said chamber whereby to increase said effective volume thereof, after said closure means has closed said inlet opening, thereby causing material in said discharge opening to be sucked back into said chamber.

More particularly, it is an objective of the invention to provide a dispenser apparatus having the foregoing advantages and where said inlet opening defines a predetermined cylindrical shape along its length and wherein said closure means comprises plunger means of cylindrical shape adapted to fit snugly within said inlet opening and close the same, and wherein said body means comprises an endwise extension of said plunger means, extending into said chamber, said plunger means and said endwise extension thereof, when said inlet opening means is open, being located within said chamber and thereby reducing the effective volume of said chamber, and, when said plunger means is withdrawn from said chamber through said inlet opening, said extension portion is then progressively removed from said chamber, thereby increasing the effective volume of said chamber and providing the suck-back action aforesaid.

More particularly, it is an objective of the invention to provide a dispenser apparatus having the foregoing advantages and including means for moving said plunger means from a first open position, located within said chamber means, to a second position, closing said inlet opening, and then to a third position, whereby said plunger means is withdrawn at least partially into said inlet opening, whereby to cause an increase in the effective volume of said chamber.

More particularly, it is an objective of the invention to provide a dispenser apparatus having the foregoing advantages, and including supply housing means communicating with a first end of said inlet opening, and a second end of said inlet opening communicating with said chamber, and including plunger operating means extending through said inlet opening, said plunger operating means being of reduced cross-section in relation to said plunger means, whereby said flowable material may flow through said inlet opening around said operating rod means, when said plunger means is in its first open position.

More particularly, it is an objective of the invention to provide a dispensing apparatus having the foregoing advantages and including bearing sleeve means communicating with said supply housing means, collar means connected with power operated means extending through said bearing sleeve means into said supply housing means, and connecting to said operating rod means, said collar means having a predetermined diameter equal to said predetermined diameter of said plunger means, and greater than said predetermined cross-section of said operating rod means whereby pressure of said flowable material in said supply housing means is applied equally to said plunger means and to said collar means.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF THE PREFERRED EMBODIMENTS

Figure 1:
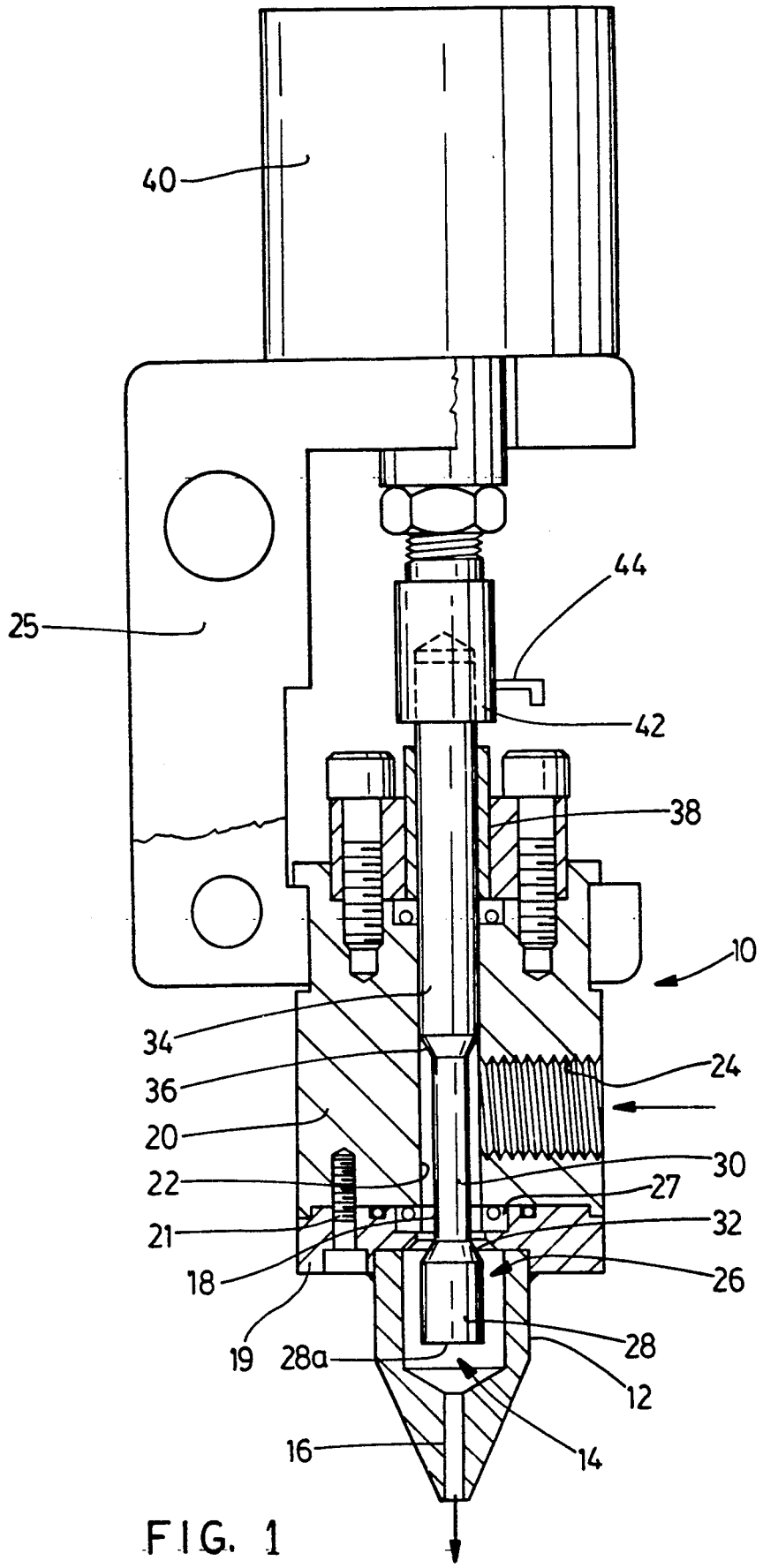
FIG. 1 is a sectional side elevation of a dispenser apparatus in accordance with the invention, shown with the plunger means in a first or open position.

Referring first of all to FIG. 1, it will be seen that the invention is there illustrated in the form of a dispenser apparatus indicated generally as 10, having a body 12 defining an interior chamber 14. Chamber 14 has a discharge outlet nozzle 16 and an inlet opening 18.

Chamber 14 defines a predetermined volume, for reasons to be described below. Body 12 is fastened to a mounting plate 19, by any suitable means such as welding, for example. Mounting plate 19 is, in turn, connected to a supply housing body 20 by any suitable means such as bolts 21.

Supply housing body 20 defines a generally regular cylindrical passage way 22 communicating through plate member 19 with inlet opening 18 of chamber 14. Flowable material is adapted to be supplied under pressure from any suitable source, through supply conduit means (not shown) of any suitable type connected to the threaded supply recess 24.

Body 20 is secured by any suitable means to a mounting bracket means 25, by means of which the entire apparatus may be supported on any suitable machinery where it may be required for dispensing flowable materials.

Preferably, the mounting bracket means 25 is of two-part construction, being split along a vertical axis, (shown partly cut away to show both halves in FIG. 1). In this way, by releasing any suitable fastening means (not shown) such mounting bracket means 25 may be separated, thereby permitting the removal of the entire dispensing apparatus, for servicing, cleaning, or the like.

Opening 18 is of a predetermined regular shape, in this case cylindrical shape along its length, and is provided with a seal 27 located between plate 19 and body 20.

Furthermore, it will be noted that the cross-section of the chamber 22 in body 20 is the same cross-section, in this case cylindrical, as the cross-section of the inlet opening 18, for reasons to be described below.

In order to open and close inlet opening 18, a closure means indicated as 26 is provided. Closure means 26, in this embodiment to the invention, consists of the upper end portion of an elongated plunger member 28 of regular shape along its length and having a predetermined cross-section. The cross-section of plunger member 28 corresponds to the cross-section of the inlet opening 18. The plunger member 28 defines a lower extension portion 28*a*, the purpose of which will become apparent from the following description.

Plunger member 28 is attached to an operating rod 30 of reduced cross-section. A shoulder 32 is formed at the transition between plunger member 28 and rod 30 for reasons to be described below.

It will, of course, be appreciated that while in FIG. 1 the plunger member 28 and the operating rod 30 are shown as being of integral one-piece construction, they could, of course, be manufactured as separate components, and fastened by any suitable means.

The cross-section of the operating rod 30 is reduced in relation to the cross-section of the cylindrical chamber 22 in body 20, and shoulder 32. Thus flowable materials entering through supply port 24, may flow downwardly around rod 30 and through inlet opening 18 into chamber 14 and out of dispensing opening 16.

Operating rod 30 is in turn connected to a shaft 34. Shaft 34 defines a cross-sectional shape corresponding to the cross-sectional shape and size of the plunger 28 already referred to. A shoulder 36 is formed at the transition between rod 30 and shaft 34, having an area corresponding to the area of the shoulder 32.

When flowable material is forced into the chamber 22, its pressure will thus be applied to both shoulder 32 and shoulder 36. These shoulders being of the same cross-sectional area will thus experience equal pressure, in both directions.

Shaft 34 is, in turn, connected through a suitable bearing or sleeve 38, to a power-operated means 40 having an operating rod 42 by a releaseable connection pin 44. The power-operated means 40 may be any suitable power operated means such as an electrical solenoid or a hydraulic or pneumatic cylinder, or any other suitable power operated means well known in the art.

In operation, when in the open position as shown in FIG. 1, flowable material will flow via the port 24 into the chamber 22, down through the inlet opening 18 which at this point is open, into the chamber 14, and flow around the plunger 28 and out through the dispensing opening or nozzle 16.

Figure 2:
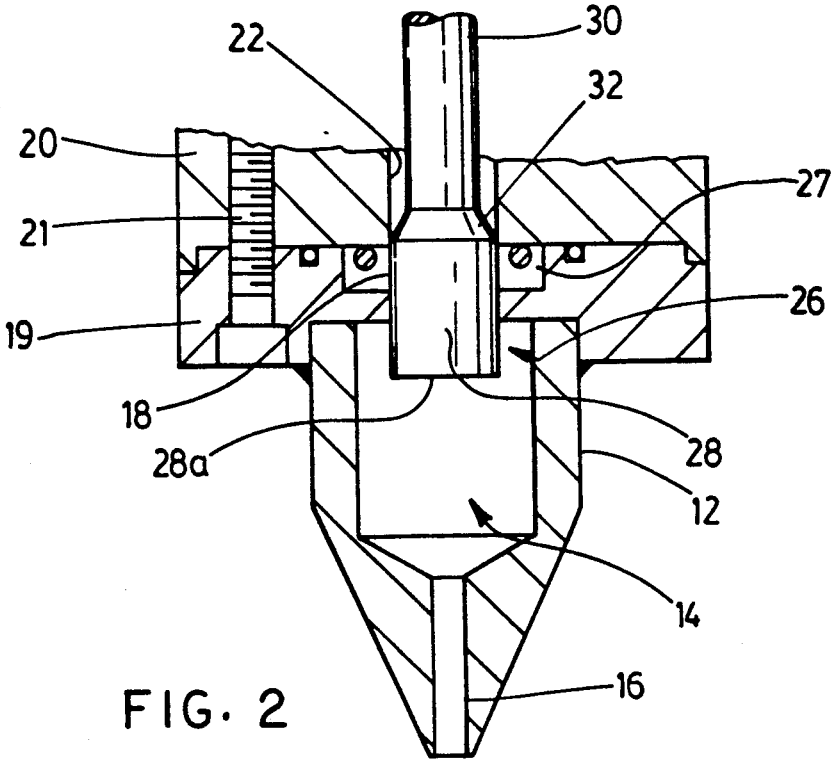
FIG. 2 is a enlarged sectional side elevation corresponding to FIG. 1, showing the plunger means in a second or closed position, and, FIG. 3 is a sectional side elevation corresponding to FIG. 2 showing the plunger means in a third or "suck-back" position.
Figure 3:
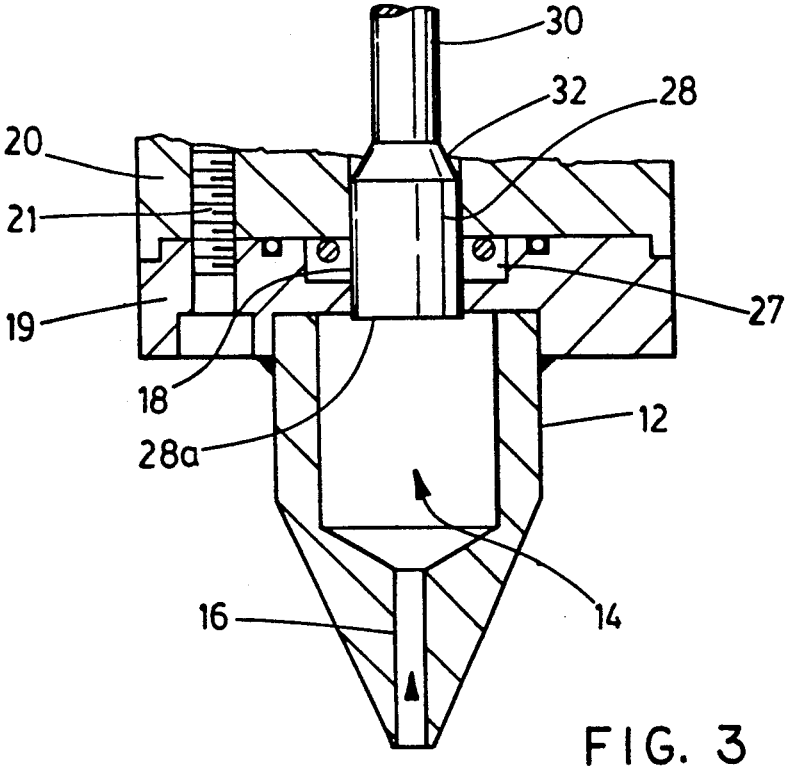

When it is desired to shut off flow of the flowable material, the power operated means 40 operates the shaft 34 which in turn operates the rod 30, drawing it upwardly. This will thus draw the plunger 28 upwardly into the inlet opening 18, as shown in FIG. 2, engaging the seal 27. This will then shut off flow of the flowable material into the chamber 14. The operating means 40 will continue to operate the shaft 34, thus drawing the plunger 28 upwardly through the inlet opening 18, and partially into the lower end of the chamber 22 in body 20. The lower extension portion 28*a* of the plunger 28 is thus withdrawn from the chamber 14, into the suck-back position as shown in FIG. 3. The seal 27 provides a sliding engagement with the plunger 28 in the extension portion 28*a* so as to maintain the inlet opening closed and sealed against flow of material therethrough during this function.

It will thus be seen that between the positions of FIG. 2 and FIG. 3 the effective volume of the chamber 14 has been increased by the extent of the lower extension 28*a* of the plunger 20. This will actually displace the volume of flowable material in the discharge opening or nozzle 16, back upwardly into the chamber 14. This will provide an abrupt and effective shut off of the flow of material from the discharge opening 16. This will prevent the release of excess material from the nozzle, which would otherwise cause stringing of the material on the work piece, or unnecessary and unwanted material on the machinery, requiring frequent clean ups, or resulting in malfunctioning of the equipment.

It will of course be appreciated that while the invention described herein is of particular application in relation to viscous flowable mateirals, it is of some application to materials having greater or lesser viscosity. Thus materials having even only a slight degree of viscosity may be dispensed in accordance with the invention described herein. It would appear that the principal limitation on the application of the invention is the effectiveness of the suck back action of the plunger member. Thus the dispensing outlet or nozzle 16 will typically be engineered so as to permit the discharge of an appropriate quantity of flowable material from the nozzle, at an appropriate discharge pressure. In the case of extremely viscous materials, the discharge opening or nozzle may be relatively large and the pressure required to achieve discharge of the material may also be relatively large for example in the region of 2–3,000 PSI.

However in the case of less viscous materials, the cross-sectional area of the discharge opening 16 may be reduced, and the pressure applied to the material to be dispensed may also be reproduced. The principal limitation on the application invention to various liquids or flowable materials is dependent on the surface tension of the flowable material itself.

While reference has been made herein at some points to liquids and at other points to flowable materials, it will be appreciated that the invention is applicable to materials which will not readily flow. In fact many forms of adhesives and other viscous material are so viscous that when placed in an open jar, and the jar is inverted, the material will not exhibit any degree of flow under gravity. However, when such materials are used in appropriate equipment able to generate substantial pressure, flow will take place, and the terms liquids, and flowable materials as used herein are intended to encompass all such material.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A dispenser apparatus for flowable materials supplied under pressure to said dispenser apparatus and comprising:

a dispensing head defining a dispensing chamber having an inlet opening and a discharge opening, and defining a predetermined volume;

plunger means having a predetermined plunger diameter adapted to be positioned in an open position in said dispensing chamber, for occupying a portion of said predetermined volume thereof, and being at least partially removable from said dispensing chamber;

a supply chamber for supplying said flowable material to said inlet opening of said dispensing chamber, said material flowing directly from said supply chamber to said inlet opening, and through said dispensing chamber around said plunger means, and out of said discharge opening, said supply chamber having a supply opening communicating directly for receiving said flowable material under pressure;

plunger operating rod means having a predetermined rod cross-section extending through said supply chamber and through said inlet opening of said dispensing chamber, said plunger operating rod means being of reduced cross-section in relation to said plunger means, whereby said flowable material flows directly from said supply chamber under pressure directly through said inlet opening around said plunger operating rod means, when said plunger means is in said open position in said dispensing chamber;

means for progressively withdrawing said plunger means from said dispensing chamber into said inlet opening to close said inlet opening and prevent further flow of said material through said inlet opening and said means for progressively withdrawing said plunger means being operable to further withdraw said plunger means from said dispensing chamber thereby causing material in said discharge opening to be sucked back into said dispensing chamber;

bearing sleeve means communicating with said supply chamber, and, collar means connected with said plunger operating rod means and extending through said bearing sleeve means into said supply chamber, said collar means having a predetermined diameter substantially equal to said predetermined diameter of said plunger means, and greater than said predetermined cross-section of said plunger operating rod means whereby pressure of said flowable material in said supply chamber is applied substantially equally to said plunger means and to said collar means.

2. A dispenser apparatus as claimed in claim 1 wherein said inlet opening defines a predetermined cylindrical shape along its length and wherein said plunger means is of cylindrical shape adapted to fit snugly within said inlet opening and close the same.

3. A dispenser apparatus as claimed in claim 1 and including means for moving said plunger means from a first open position, located within said dispensing chamber to a second position, closing said inlet opening, and then to a third position, whereby said plunger means is withdrawn at least partially into said inlet opening, whereby to withdraw the same from said chamber.

4. A dispenser apparatus as claimed in claim 3 wherein said means for moving said plunger means comprises a power-operated means and releaseable coupling means coupling said power-operated means to said plunger means.

5. A dispenser apparatus as claimed in claim 4 including mounting bracket means adapted to support said apparatus, said mounting bracket means being releaseable from said apparatus whereby to permit removal of said apparatus for servicing.

6. A dispenser apparatus as claimed in claim 1 wherein said supply chamber defines an interior passageway, said passageway having a predetermined cross-section corresponding to the cross-section of said inlet opening, whereby said plunger means may be withdrawn through said inlet opening into said passageway.

7. A dispenser apparatus as claimed in claim 6 including sealing means positioned adjacent said inlet opening, said sealing means being adapted to seal around said plunger means, while permitting the same to slide therethrough.

* * * * *